United States Patent [19]

Heinzer et al.

[11] 3,980,294

[45] Sept. 14, 1976

[54] PHOTOCOPYING MACHINES

[75] Inventors: Paul Heinzer, Zurich; Helmut Wulz, Birmensdorf, both of Switzerland

[73] Assignee: Wito Wissenschaftliches Forschungs-Institut A.G., Zurich, Switzerland

[22] Filed: Feb. 11, 1975

[21] Appl. No.: 549,050

[30] Foreign Application Priority Data

Feb. 11, 1974 Switzerland ..... 1859/74

[52] U.S. Cl. ..... 271/197; 271/276; 198/689

[51] Int. Cl.[2] ..... B65H 5/02; B65H 29/16

[58] Field of Search ..... 271/34, 197, 275, 276; 198/DIG. 7, 184, 193

[56] References Cited

UNITED STATES PATENTS

| | | | |
|---|---|---|---|
| 3,373,989 | 3/1968 | Le Baron | 271/34 |
| 3,482,676 | 12/1969 | Fackler | 198/193 |

FOREIGN PATENTS OR APPLICATIONS

| | | | |
|---|---|---|---|
| 1,033,225 | 7/1958 | Germany | 271/197 |

*Primary Examiner*—Evon C. Blunk
*Assistant Examiner*—Robert Saifer
*Attorney, Agent, or Firm*—Stewart and Kolasch, Ltd.

[57] ABSTRACT

A photocopying machine which includes a band conveyor for transporting sheet material through the machine, the conveyor including end drums supporting a band of seamless and endless perforated metal with its upper run disposed over a suction chamber.

2 Claims, 1 Drawing Figure

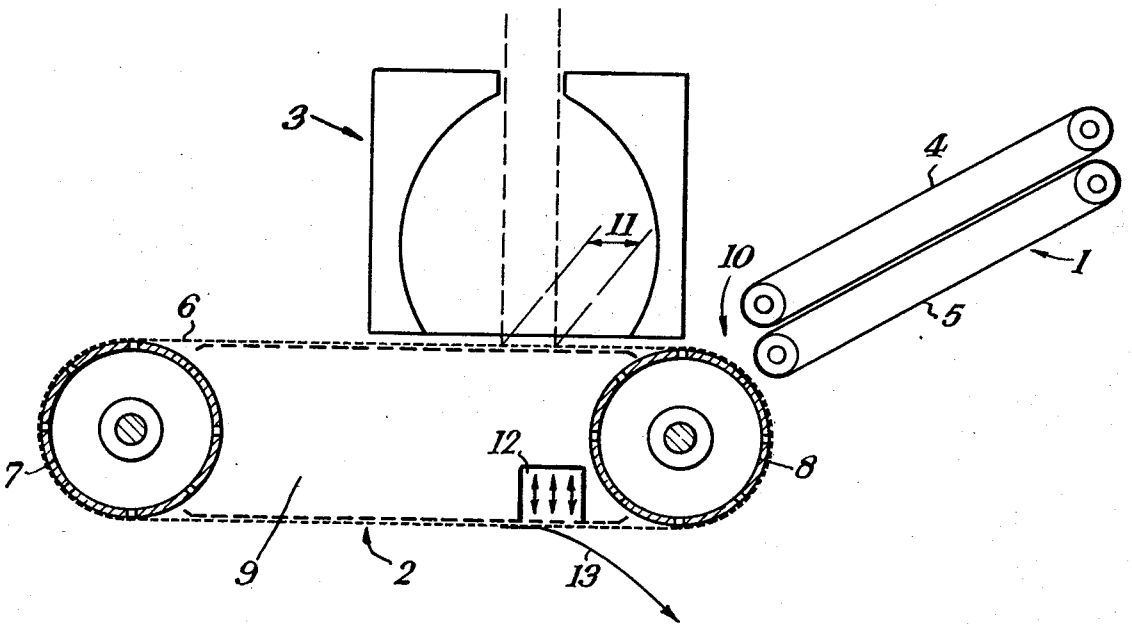
1
4
5
10
8
11
3
12
13
2
9
6
7

PHOTOCOPYING MACHINES

It is necessary in a photocopying machine, in which copies of an original travelling through the machine are to be made on copy sheets separately conveyed through the machine, to ensure correct registration of the original and the copy sheet in the copying zone. The error in travel of the copy sheet in relation to the original must not exceed 1%, if a resolution of 7 lines/mm is to be obtained in copies having a length of 30mm.

The original and copy sheets must therefore travel without slip and both sheets should be positioned in the copying zone with an accuracy of ± 0.5 mm. The required accuracy cannot, in general, be achieved with the existing forms of band conveyor used in photocopying machines.

The invention accordingly provides a photocopying machine which includes a band conveyor for transporting sheet material through the machine, the conveyor including end drums supporting a band of seamless and endless perforated metal with its upper run disposed over a suction chamber.

When copies are to be made on transparent material, it is desirable that the conveyor band should absorb the minimum of light and have a diffusely reflecting surface. This may be achieved by suitable treatment of the metal band or, as described below, by providing it with a suitable reflecting surface coating.

One embodiment of the invention will now be described in more detail, by way of example, with reference to the accompanying diagrammatic drawing which shows part of an electrophotographic copying machine.

Copy sheets are fed in succession at the point 10 by an infeed system 1, constituted by a pair of belts 4 and 5, to the upper run of the band 6 of a band conveyor 2 which travels beneath a light source 3. The image of an original is projected on to the copy sheet by an optical system (not shown) through a gap marked 11. The original is conveyed through the machine by another conveyor band (not shown but identical with the band 6) which travels through the machine in a direction at right angles to the band 6.

The band 6 is perforated and is supported by drums 7, 8, one of which is driven, with its upper run disposed above a suction chamber 9, which may if desired be subdivided into a number of adjacent suction chambers. The suction acts on the undersurface of the copy sheet through the perforations in the band 6 to ensure that the copy sheet will be held firmly to the surface of the band 6, so that its movement will be kept in register with that of the original which is likewise held by suction to the band conveying it. This is necessary to prevent blurring of the copy formed on the copy sheet.

The drums 7 and 8 are also perforated. After passage around the drum 7, the copy sheet is stripped from the bottom run of the band 6, as indicated by the arrow 13, by air pressure derived from a chamber 12.

The band 6 is constituted by a perforated seamless strip of metal, which may conveniently have a thickness in the range of 50 to 150$\mu$. It may, for example, be produced by galvanic deposition of metal or a nickel-cobalt alloy. The width of the band 6 is appropriate for transport of sheets of size A 00 and may conveniently be 840 mm.

To avoid slip in the drive of the band 6, it may have regularly spaced holes in one or both edges which are engaged by correspondingly pitched teeth on at least one of the drums 7, 8.

To permit copies to be made on transparent copy sheets, the surface of the band is such as to provide diffuse reflection of light. This may be effected by appropriate treatment of the metal surface or by providing the band 6 with a suitable white surface layer, e.g. of barium oxide, zinc oxide or titanium oxide. The surface layer may, for example, be applied by electrophoresis, dipping or spraying.

It is desirable to wash the reflecting surface from time to time to remove contamination which would impair its reflecting properties.

As already stated, the other conveyor band which conveys the original through the machine is also of perforated seamless metal and it may be arranged to recirculate the original through the machine to produce multiple copies.

The band 6 holds the copy sheet firmly by the suction applied to its entire surface and transports it positively through the exposure zone in correct register with the original.

What we claim as our invention and desire to secure by Letters Patent is:

1. In a photocopying machine, a band conveyor for transporting sheet material through the machine, said conveyor comprising end drums, an endless perforated conveyor band extending around said end drums to provide an upper run and a lower run, said band being made of a seamless metal having a surface layer of white material selected from the group consisting of barium oxide, zinc oxide and titanium oxide which provides diffuse reflection of light, and a suction chamber disposed beneath the upper run of said band.

2. In a photocopying machine, a band conveyor for transporting sheet material through the machine, said conveyor comprising end drums, an endless perforated conveyor band extending around said end drums to provide an upper run and a lower run, said band being made of a galvanically deposited metal, and a suction chamber disposed beneath the upper run of said band.

* * * * *